US006065859A

United States Patent [19]

Breeding

[11] Patent Number: 6,065,859

[45] Date of Patent: May 23, 2000

[54] PORTABLE PENDULOUS CONCRETE VIBRATOR

[75] Inventor: Kenny D. Breeding, Little Rock, Ark.

[73] Assignee: Iskoo Ltd, Maumelle, Ark.

[21] Appl. No.: 09/184,215

[22] Filed: Nov. 2, 1998

Related U.S. Application Data

[63] Continuation-in-part of application No. 08/738,088, Oct. 25, 1996, Pat. No. 5,829,874, which is a continuation-in-part of application No. 08/673,371, Jun. 28, 1996, Pat. No. 5,716,131.

[51] Int. Cl.[7] ..... B01F 11/04

[52] U.S. Cl. ..... 366/121; 366/122

[58] Field of Search ..... 366/108, 116, 366/117, 120–123, 128, 129, 600, 601

[56] References Cited

U.S. PATENT DOCUMENTS

| | | | |
|---|---|---|---|
| Re. 21,684 | 1/1941 | Mall | 366/123 |
| 1,981,076 | 11/1934 | Sells | 224/262 |
| 2,167,987 | 8/1939 | Mall | 366/122 |
| 2,194,410 | 3/1940 | Svenson | 366/120 |
| 2,430,817 | 11/1947 | Jackson | 366/123 X |
| 2,437,983 | 3/1948 | Wenander | 366/120 |
| 2,492,431 | 12/1949 | Kroeckel | 366/122 |
| 2,519,936 | 8/1950 | Sayre | 224/261 |
| 2,546,806 | 3/1951 | Wenander | 366/120 |
| 2,597,505 | 5/1952 | Lindkvist | 366/121 |
| 2,603,459 | 7/1952 | McCrery | 366/122 |
| 2,792,670 | 5/1957 | Haynes | 224/265 X |
| 3,042,386 | 7/1962 | Wyzenbeek | 366/122 |
| 3,152,791 | 10/1964 | Svenson | 366/120 |
| 3,180,625 | 4/1965 | Wyzenbeek | 366/122 |
| 3,188,054 | 6/1965 | Mason Jr. | 366/121 |
| 3,283,598 | 11/1966 | Barnes | 366/121 |
| 3,294,370 | 12/1966 | Hedelin | 366/120 |
| 3,340,742 | 9/1967 | Chandler | 366/123 |
| 3,395,894 | 8/1968 | Hedelin | 366/121 |
| 3,608,867 | 9/1971 | Hunter | 366/120 |
| 4,483,070 | 11/1984 | Junkermann | 224/262 X |
| 4,644,654 | 2/1987 | Howe et al. | 224/262 X |
| 4,658,778 | 4/1987 | Gamoh et al. | 224/644 X |
| 4,662,551 | 5/1987 | Dudley et al. | 224/262 X |
| 5,716,131 | 2/1998 | Breeding | 366/120 |

FOREIGN PATENT DOCUMENTS

| | | | |
|---|---|---|---|
| 2319946 | 11/1974 | Germany | 366/123 |
| 2642306 | 3/1978 | Germany | 366/120 |
| 354605 | 7/1961 | Sweden | 366/120 |
| 357901 | 12/1961 | Sweden | 366/123 |
| 192622 | 11/1964 | Sweden | 366/120 |
| 768419 | 2/1957 | United Kingdom | 224/265 |

*Primary Examiner*—Charles E. Cooley
*Attorney, Agent, or Firm*—Stephen D. Carver

[57] ABSTRACT

A portable, hand-held concrete vibrating system employs a pendulous vibrator driven by a high speed, two-cycle motor that operates up to speeds of between 5000 and 6000 RPM. An elongated, rod-like frame supporting the motor is connected at its remote end to a vibrator head adapted to be immersed in plastic concrete. A pivoted weight generally coaxially disposed within the head forcibly causes vibrations in response to internal impacts. A compensating system within the head torsionally couples the flexible drive cable to the pendulous weight and accommodates axial and rotational stresses caused by high speed rotation. The compensating system, preferably disposed between sets of self aligning bearings, comprises a rigid power input end coupled to a rigid power output end by a resilient, preferably buna rubber midsection. The pendulous weight extends from a pivotal connection at the power output end of the compensation system to an integral, unbalanced, generally conical impact end, the side profile of which forms an angle of approximately 1.0–1.5 degrees with reference to the longitudinal axis of the vibrator head.

19 Claims, 8 Drawing Sheets

PORTABLE PENDULOUS CONCRETE VIBRATOR

CROSS REFERENCE TO RELATED APPLICATION

This patent application is a Continuation-In-Part of application, Ser. No. 08/738,088, Filed Oct. 25, 1996, entitled Vibrating system-Mounted Pivoting Motor for Concrete Finishing, now U.S. Pat. No. 5,829,874, which was a Continuation-In Part of application Ser. No. 08/673,371, filed Jun. 28, 1996 entitled Portable Four Cycle Vibrating system Pendulous Vibrator, now U.S. Pat. No. 5,716,131.

BACKGROUND OF THE INVENTION

I. Field of the Invention

The present invention relates generally to portable, motorized concrete vibrator tools. More particularly, my new invention relates to a portable, motor-driven, pendulous vibrator system for consolidating freshly poured concrete. Prior art relative to my new system may be found in Class 366, subclasses 117, 120–123, 128, and 129.

II. Description of the Prior Art

It is well settled that freshly poured concrete must be properly vibrated after placement for adequate consolidation. Properly-applied vibration settles and densifies the concrete mass, and eliminates air voids. Preexisting concrete vibrating equipment ranges from extremely large, vibrating screed units that ride upon forms while traversing freshly poured concrete, to smaller, portable units which can be handled by a single workman. The smaller units may include motor-driven tools associated with a portable system. These enable the contractor to properly densify smaller-to-medium pours that are difficult to reach with large conventional units. Portable vibrator systems enable the operator to easily reach certain locations that are inaccessible to large screeds. Backpack systems readily transport and control a fairly substantial vibration unit that is capable of densifying several yards of green concrete.

Some jobs are so small that even a backpack system amounts to overkill. Miniature hand-held units, for example, may be capable of properly handling smaller pours in the order of a couple of yards or less. Providing their horsepower ratings and vibrational output are satisfactory, they may be able to properly consolidate smaller pours within the curing time frame associated with quick setting cement.

U.S. Pat. Nos. 4,483,070, 4,644,654, 4,662,551, 4,658,778, 2,519,939, 2,792,670, 1,981,076, and Great Britain Pat. No. 768,419 all show various forms of motorized tools that are transported upon a backpack worn by the user.

U.S. Pat. Nos. 2,167,987, 2,603,459, 2,597,505, 3,608,867, 3,395,894, and Reissue No. 21,684, show vibrating heads suitable for concrete work that are activated by motor-driven cables to produce vibration.

U.S. Pat. Nos. 2,430,817, 2,492,431, 3,042,386, 3,180,625, and 3,188,054 all depict hand-held, portable vibrating machines for treating concrete that have remote vibrator heads adapted to be immersed in freshly poured cement.

Known portable vibrator systems employ a two-cycle engine that must run at relatively high RPM. The engine connects via a flex-shaft cable to an eccentric vibrator unit that is immersed within the concrete. As the engine rotates the flex-shaft through the cable, vibration created by the eccentric vibrator is transmitted to the concrete. During operation, heat builds up and the flex-shaft and casing components expand. Expansion causes "preloading," in that the flex-shaft is pressured axially, stressing mechanical parts. Also, the flex shaft itself is stressed radially, causing excessive rubbing against the outer casing. This stress and rubbing weakens the parts, and the excessive friction generates heat that burns the hands of the operator.

Two-cycle engines are normally used to reach the desired RPM ranges for proper vibration frequencies. These engines normally run very hot, partly because they run at relatively high RPM's. With known eccentric vibrators, two-cycle engines lack the proper torque at low RPM's. Additionally, two-cycle motors require a proper mixture of gasoline and oil for optimum operation. However, in the field, the reality is that improper oil-gas mixtures are often used. Further, operators often over-rev the engines to obtain the relatively high rotational speed required by traditional flex-shaft eccentric vibrators to produce high frequency vibration. Speed increases can aggravate the heat problem. As a result, two-cycle systems can be inefficient, cumbersome, and unreliable.

Nevertheless, two-cycle engines have traditionally been preferred because they generally produce higher RPM's. High speed is necessary for traditional flex-shaft eccentric vibrators. Further, two-cycle engines are usually smaller and significantly lighter than conventional four cycle engines. These reasons dictate their common use in portable vibrating systems and in a variety of portable, hand-held appliances such as rotary grass trimmers.

Common knowledge might suggest the use of four cycle engines. They may be heavier and slower, but they are inherently more reliable and they are comparatively maintenance free. However, four-cycle engines are seldom used with conventional portable vibrators, since smaller, lightweight units are thought by many to be incapable of the required horsepower and rotational speed. Gear systems have been tiled for increasing speed with four-cycle systems, but the resultant size and weight render such designs unfit for one-man, portable systems.

Pendulous vibrators are known in the art. They are virtually maintenance free when compared with typical eccentric vibrators. Pendulous vibrators produce high frequency vibration with a relatively low RPM input. They effectively multiply the primary input speed of the drive cable system three to five times. However, they require more torque than typical, flex-shaft eccentric vibrators. In the past, pendulous vibrators I have tested overly stressed two-cycle drive systems, causing premature bearing failure from the stress of heat and unbalanced loads. Moreover, the internal construction of the pendulous vibrating head used in previous designs cannot withstand the high speed of two-cycle motors combined with the lightweight design needed in a truly portable, hand-held design.

For small, portable systems it would seem desirable to combine a two cycle engine with a pendulous vibrator. An ideal portable system should meet a number of requirements. First, the system must enable the user to safely and comfortably transport the load with his hands without unbalancing him and causing him to fall. Operator maneuverability must be enhanced. Weight must be minimized, and it must be distributed relatively evenly to preserve operator mobility and balance. Mechanical parts should be flushly and compactly mounted- they must not obstruct or contact the operator. The unit must be stable, even when the engine is running wide open, so that applicator dexterity is only minimally compromised. Vibration and heat must be isolated from the user if possible. Most importantly, the reliability of the vibrator head must be preserved. For high-speed operation, particularly with two-cycle drive motors, special design precautions must be taken within the coupling apparatus controlling the weight inside the vibrator head.

SUMMARY OF THE INVENTION

My portable, hand-held, motorized vibration system is ideal for smaller concrete pours. An elongated, rod like frame provides a handy gripping point for both hands of the workman. One end of the frame mounts a small, two-cycle engine, and the opposite frame end connects to a remote vibration head. The motor powers the vibrating head by an interiorly disposed, flex-drive cable that coaxially extends through the frame. The head is immersed within the concrete pour for settling and consolidating the cement. The frame mounts a pair of ergonomic handles that result is optimum balance and control.

Preferably the engine is two-cycle. The pendulous weight within the vibrator is interiorly coupled to the flex-drive cable through an elongated coupling having a resilient, preferably rubber body portion. Cable elongation and contraction is accommodated by other fittings within the vibrator head. Proper vibrational speed and amplitude is insured by the shape and disposition of the pendulous weight within the vibrating head. These and other special design considerations within the pendulous vibrator render it suitable for lightweight, portable use with a simple two-cycle motor.

Thus, a primary object of the present invention is to provide a portable, hand-held, concrete vibrating system.

Another object is to provide a hand-held vibrator system for consolidating concrete that enables the user to safely and comfortably move about a job site.

A related object is to provide a portable concrete vibrator of the character described that produces suitable vibrational forces with a two-cycle motor turning approximately 5000 RPM.

More particularly, an important object to provide a portable vibrator that produces approximately 9000 to 15000 vibrations per-minute with a two-cycle motor turning approximately 3000 to 5000 RPM.

A related object is to provide a hand-held concrete vibrator that will not unbalance the operator.

A still further object is to provide a concrete vibrator of the character described that enhances operator maneuverability.

Another object is to minimize weight.

A related object is to distribute the mass of the device relatively evenly to preserve operator mobility and balance.

Another object is to provide a portable vibrator of the character described that is highly stable, even when the engine is running at full throttle.

Another important object is to provide a hand-held concrete vibrating system that successfully unites a pendulous vibrator with either a two-cycle or four cycle gasoline engine.

A related object is to provide a flex-shaft system for a hand-held concrete vibrating system that successfully drives a pendulous vibrator with either a four-cycle or two-cycle engine.

A related object is to provide a pendulous vibrating system for concrete work that is comfortable and stable while promoting operator maneuverability.

These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION

Figure 1:
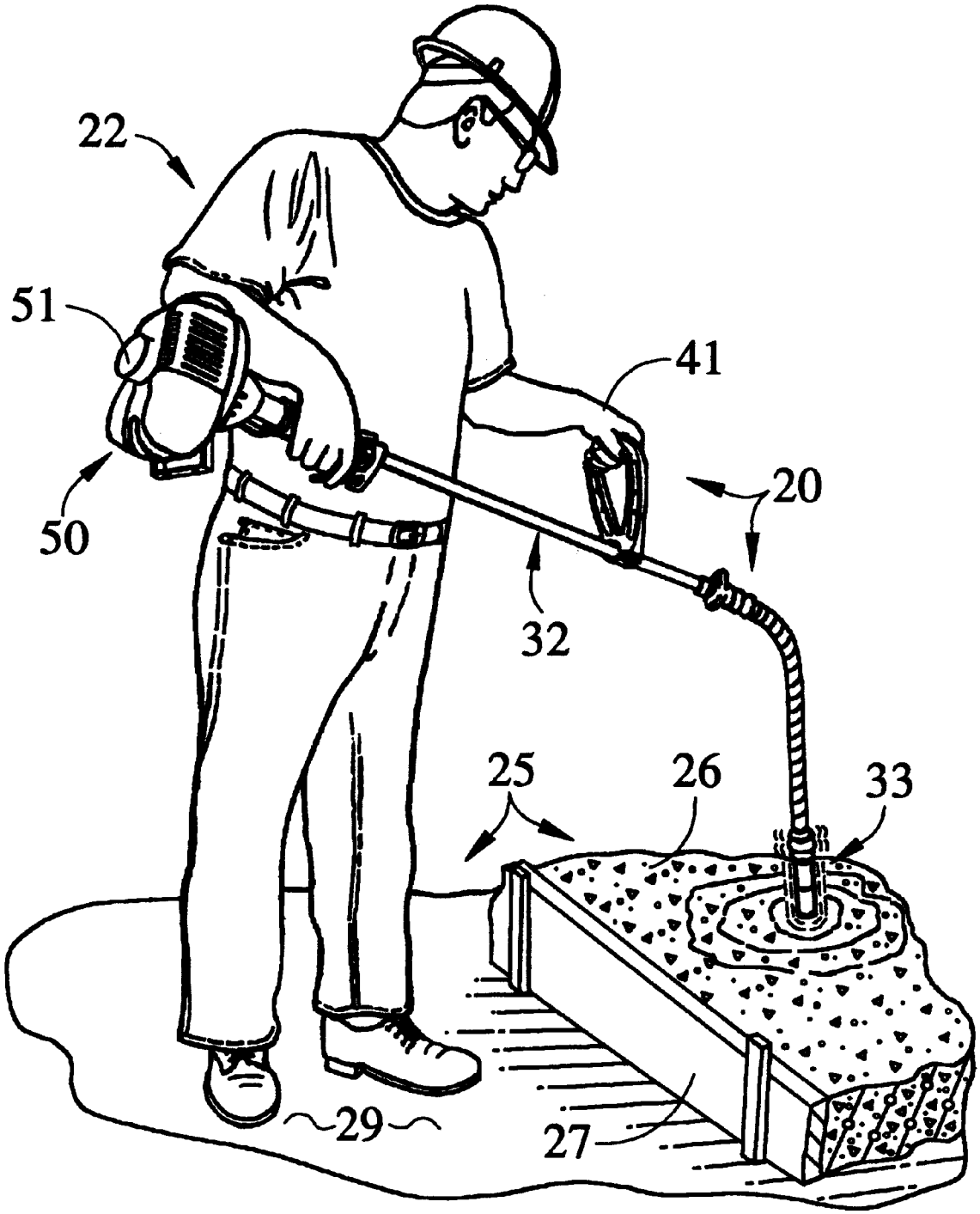
FIG. 1 is a fragmentary, pictorial view showing a preferred embodiment of my portable concrete vibrating system in use by a workman.
Figure 2:
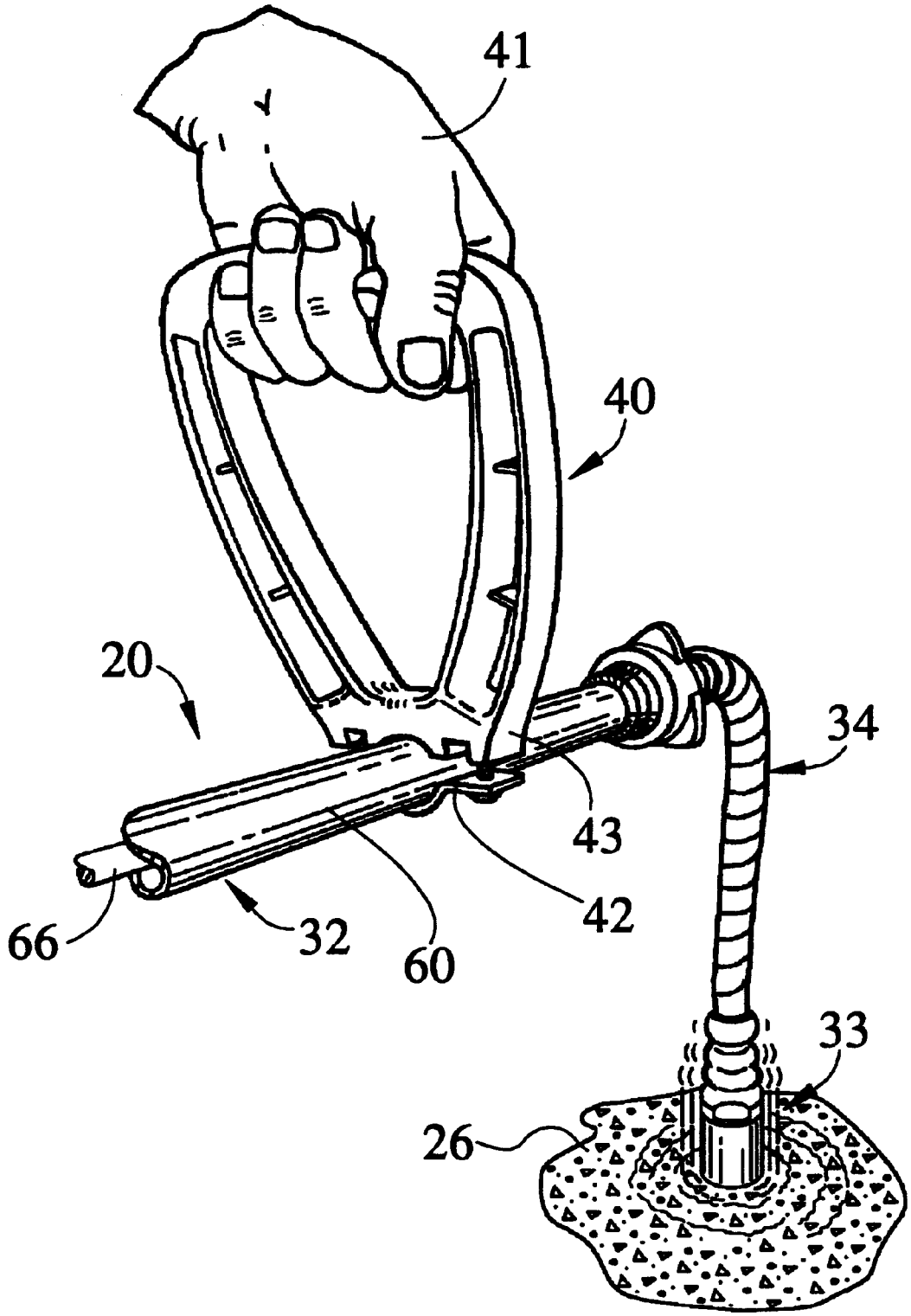
FIG. 2 is a greatly enlarged, fragmentary, pictorial view showing the support handle and the vibrating head.
Figure 3:
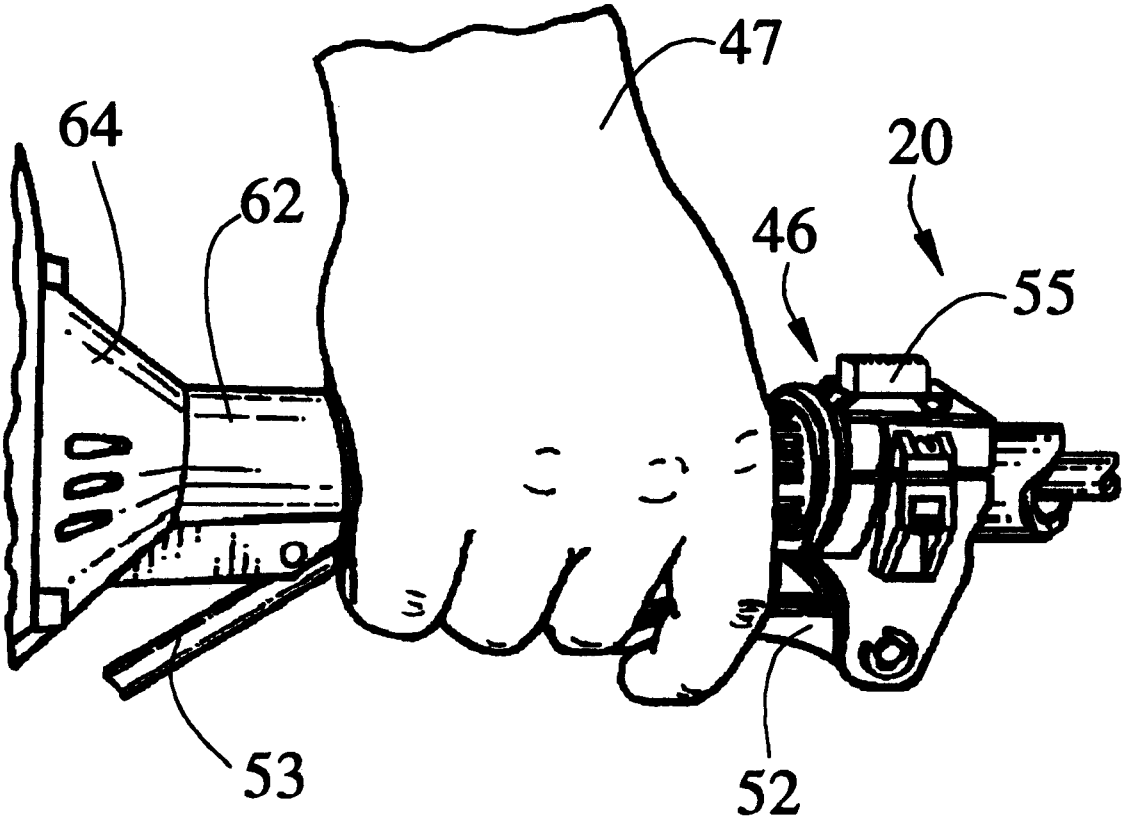
FIG. 3 is a greatly enlarged, fragmentary, pictorial view showing the preferred control handle.

Referring initially to FIGS. 1–3 of the drawings, my portable concrete vibrating system is generally designated by the reference numeral 20. The vibrator system 20 is easily hand carried by single workman or user 22 for transportation and deployment around a job site 25. In FIG. 1, the workman 22 is illustrated treating a pour 26 of wet cement, restrained by suitable conventional forms 27 erected upon surface 29 at work site 25. The motor power unit 50 supported atop the elongated, tubular frame 32 powers a remote, pendulous vibrator head 33 substantially immersed within pour 26. The vibrator head 33 is flexibly coupled to the frame or drive unit by a flexible hose 34.

As illustrated, a right-handed workman 22 may hold the vibrator system 20 by grasping front handle 40 with his left hand 41 (FIG. 2), while grasping the motor control unit 46 (FIG. 3) with his right hand 47 (FIG. 3). Handle 40 is in the form of a closed loop, with a bottom end 43 fastened to sheath 60 (FIG. 2) with a suitable bracket 42. The preferred power unit 50 comprises a two cycle internal combustion engine 51 mounted at the rear end of the frame. Engine 51 is conventionally controlled by throttle 52 (and cable 53) and kill switch 55 (FIG. 3).

Figure 4:
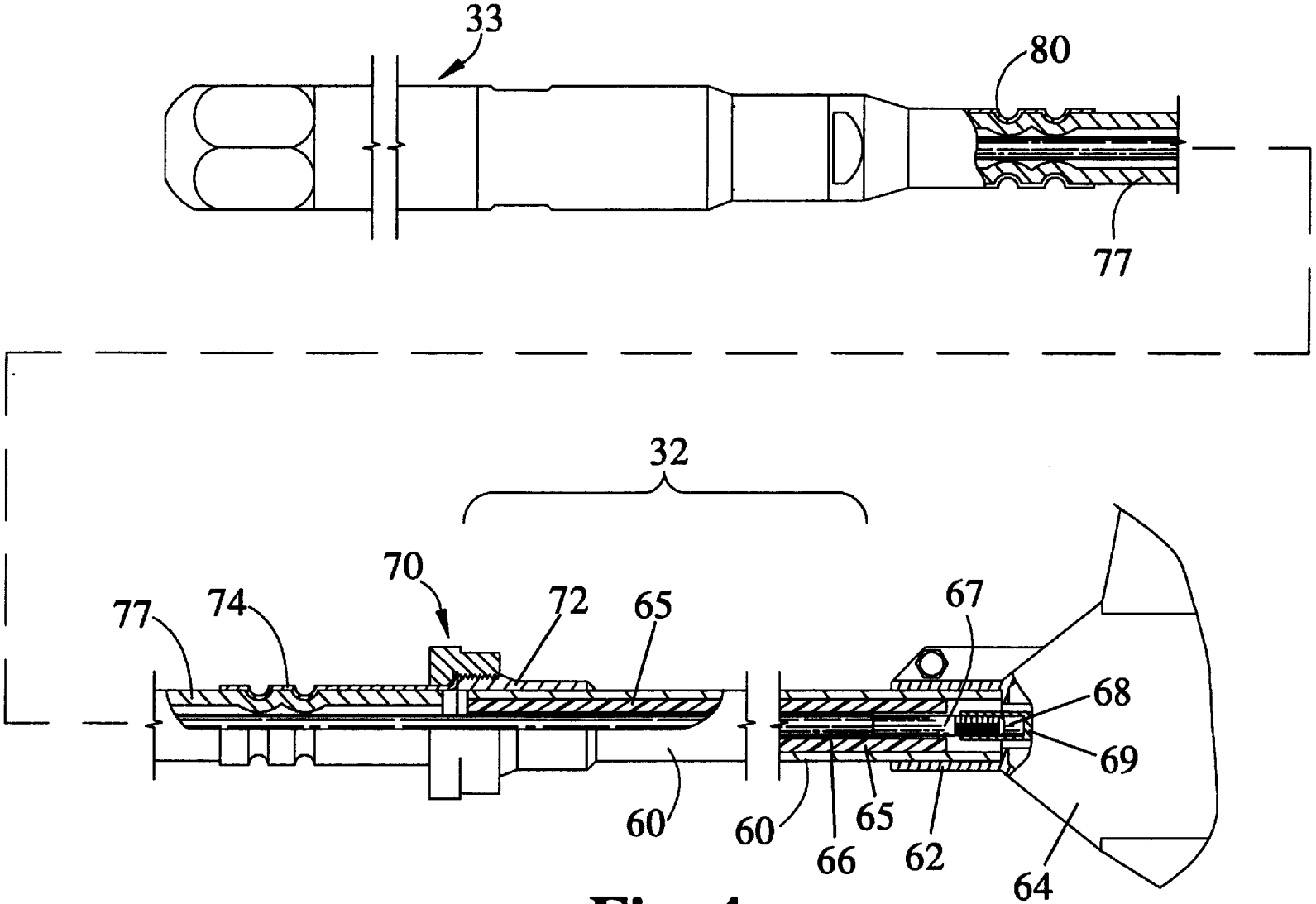
FIG. 4 is an enlarged, fragmentary longitudinal sectional view of the preferred power hose.
Figure 5:
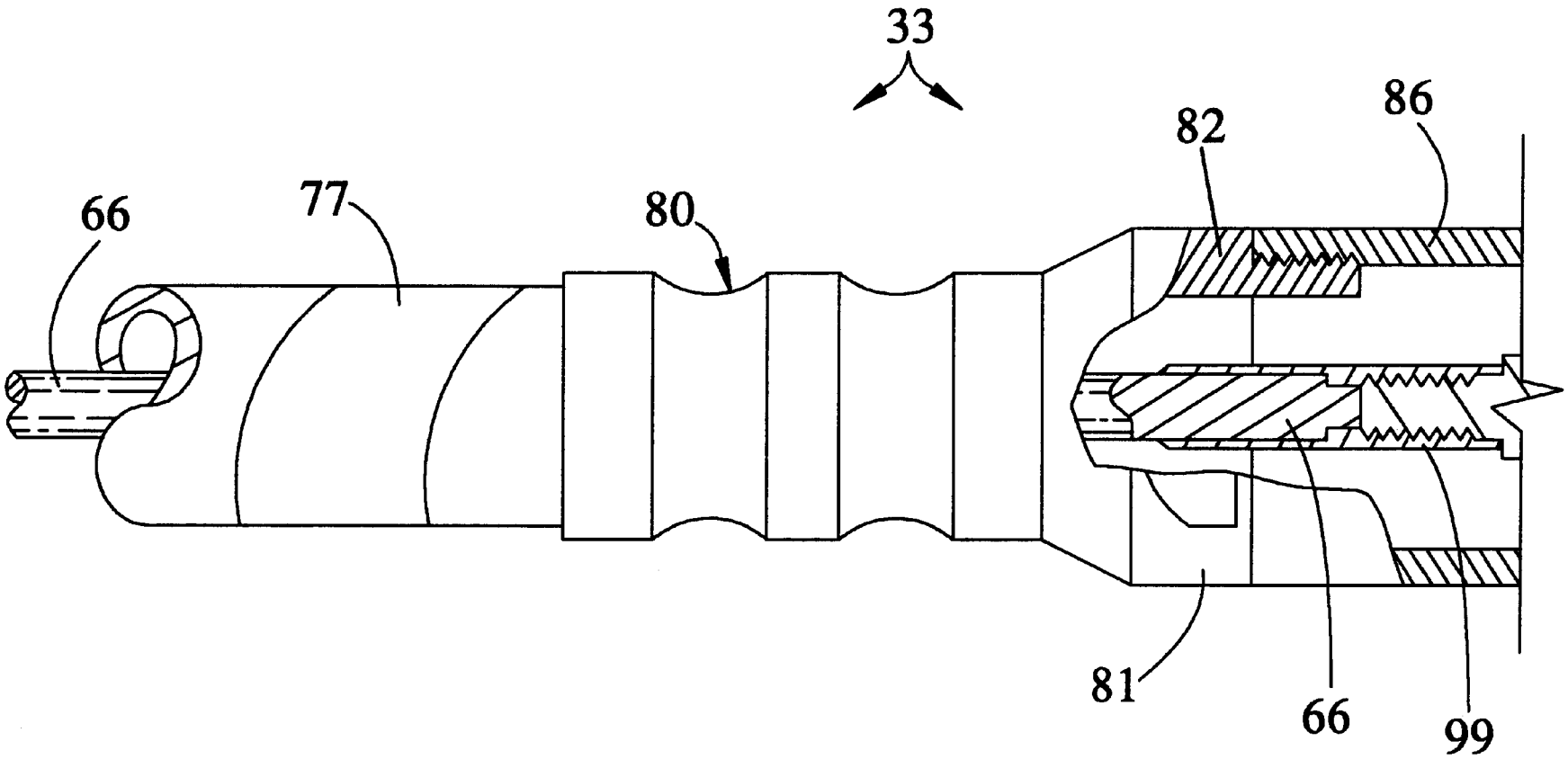
FIG. 5 is an enlarged, fragmentary, longitudinal sectional view of the hose end of the preferred pendulous vibrator head.

With joint reference directed to FIGS. 2–4, rigid sheath 60 is press is fitted into a yoke 62 that is integral with motor cowling 64 (FIG. 4). An elongated drive cable 66 is coaxially disposed within sheath 60, coaxially surrounded by an elongated, resilient, plastic tube 65 that reinforces and lubricates the turning cable. Cable 66 is rotationally engaged by an axially slidable coupling 68 that is driven by a motor output shaft 69. The axial movements of the cable 66 and coupling 68 adapt for deformation and bending of the vibrator hose during operation. Sheath 60 rigidly terminates in a threaded, tubular sleeve 72 that coaxially abuts a resilient, tubular coupling 74. Threaded union 70 (FIG. 4) attaches sleeve 72 to coupling 74. The coupling 74 is coaxially coupled to flexible hose 77 by crimp fitting. Flexible hose 77 leads to the vibrator head 33, terminating in a crimped coupling 80 similar to coupling 74 described previously.

Figure 6:
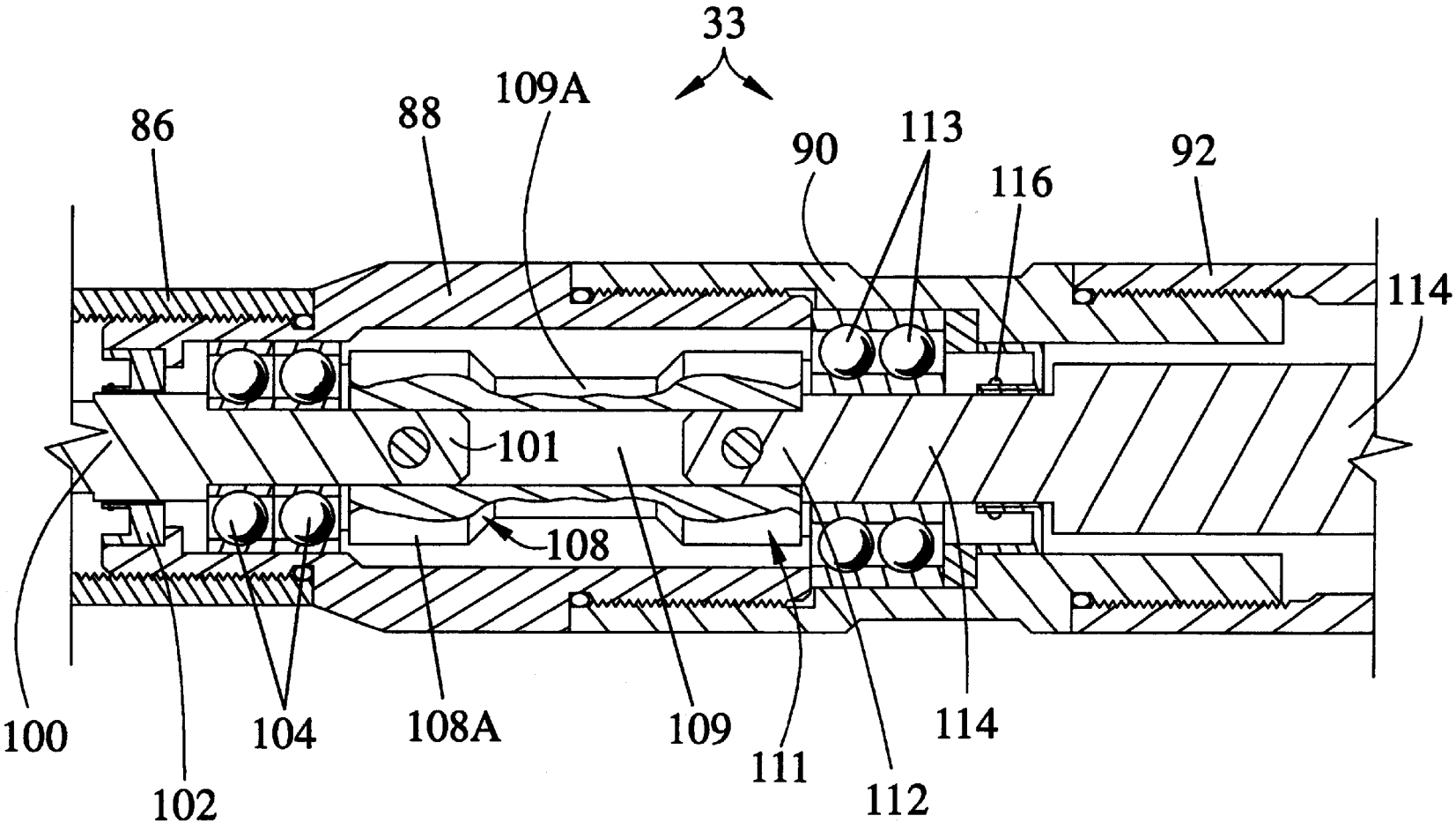
FIG. 6 is an enlarged, fragmentary, longitudinal sectional view of the middle of the preferred pendulous vibrator head.
Figure 7:
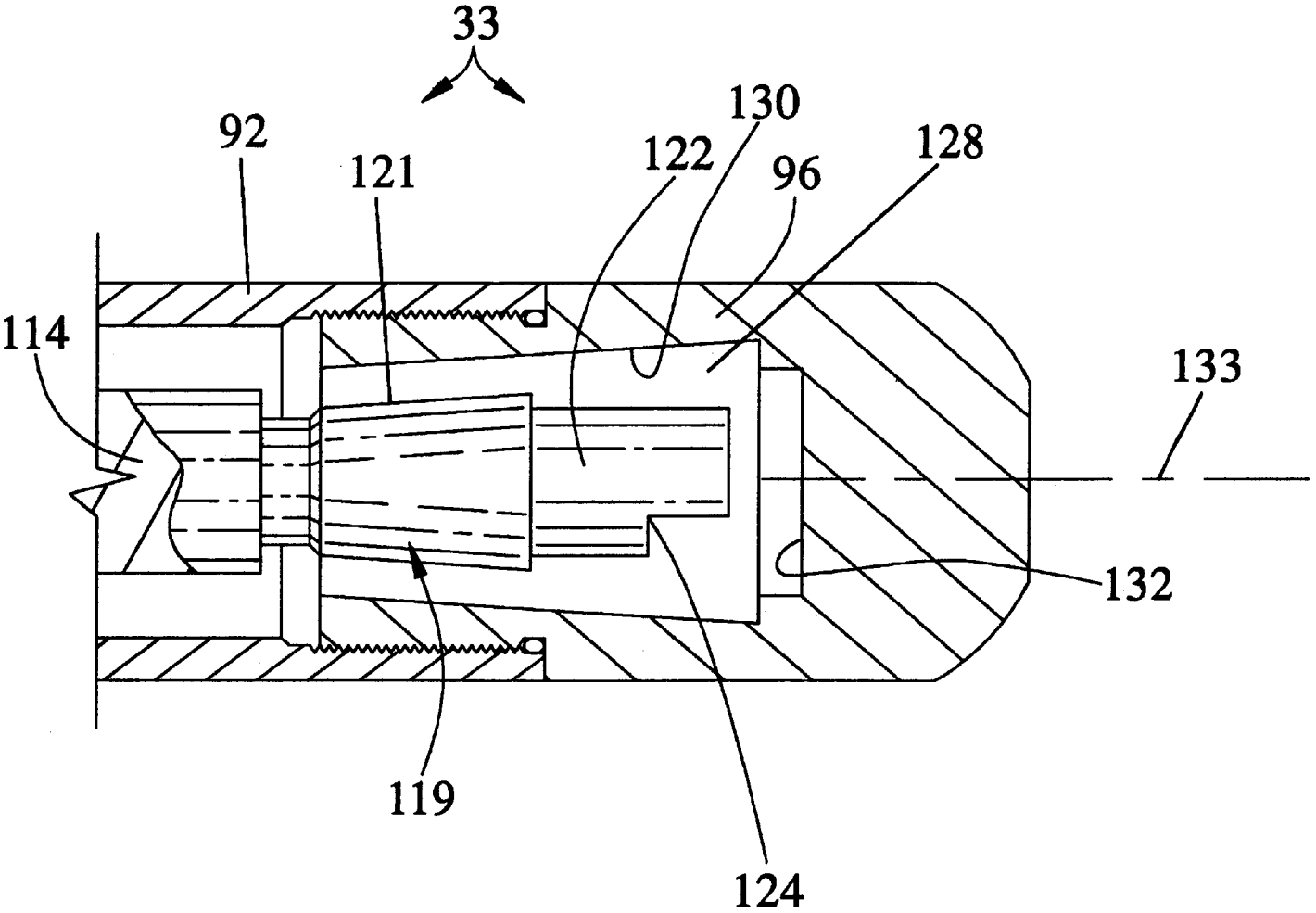
FIG. 7 is an enlarged, fragmentary, longitudinal sectional view of the bottom impact end of the preferred pendulous vibrator head; and, FIG. 8 is a diagrammatic view indicating the proper layout FIGS. 5–7 for viewing.
Figure 8:
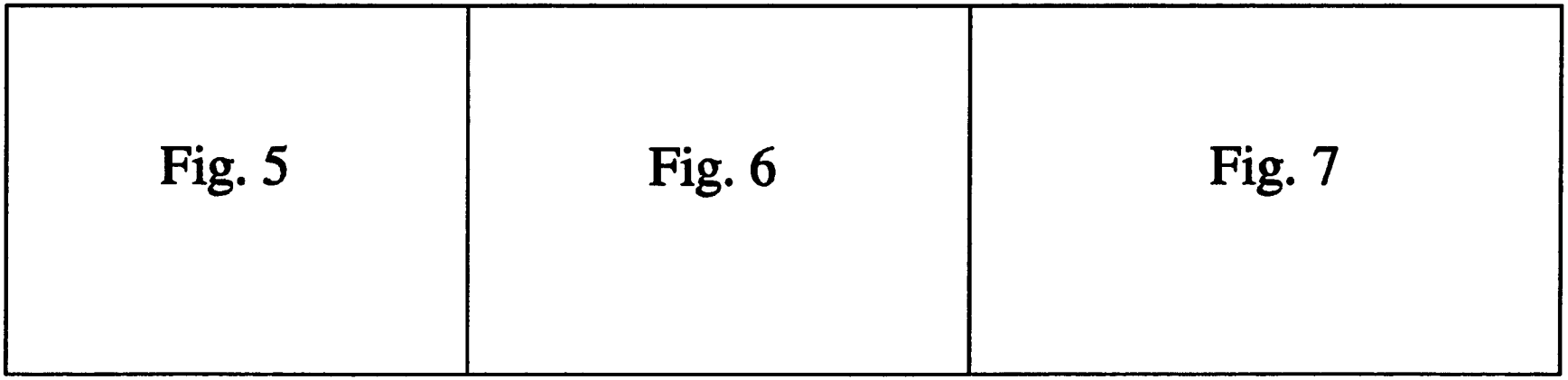

With primary emphasis directed now to FIGS. 5–8, the vibrational head 33 has an internal collar 82 (FIG. 5) to which the enlarged end 81 of coupling 80 is attached. Coupling 80 is attached at its opposite end to hose 77 that shrouds the internally disposed flexible, drive cable 66. Collar 82 is threadably, coaxially connected to sleeve 86 (FIGS. 5,6), which is in turn threaded to an intermediate barrel 88 (FIG. 6). Barrel 88 is coaxially, threadably coupled to another sleeve 90 in turn coaxially, threadably connected to a tubular, resilient tube body 92. The tube body 92 is coaxially, threadably connected to a hollow, hex nose piece 96 (FIG. 7) forming the bottom tip of the vibrating head 33.

The drive cable 66 is coaxially secured within sleeve 86 to a ferrule fitting 99 (FIG. 5) by crimping. Fitting 99 terminates an axially deflectable terminal 100 (FIG. 6), that coaxially penetrates an oil seal 102 adjacent fixed bearings 104. Importantly, a stress compensation system is internally provided by a tubular flex coupling 108 ensconced coaxially within barrel 88. The rigid, metal, power input end 108A (FIG. 6) coaxially, threadably receives the end 101 of terminal 100. The rigid and spaced apart power output end 111 (FIG. 6) of coupling 108 threadably receives the reduced diameter end 112 of weight 114. A flexible, resilient midportion extends between ends 108A, 111. Hollow region 109 is defined by midportion 109A that is preferably made of braded, buna rubber. Tubular portion 109A is slightly deformable to accommodate axial and radial shifts in the position of weight end 112 and terminal 100. In combination with bearings 104, 113, the coupling 108 provides a measure of "give" to the vibrating weight and its connecting hardware, so that dimensional re-alignments during high speed rotation and bending of the hose 77 and the internal drive cable 66.

Pendulous weight 114 is supported by self-aligning bearings 113 and coaxially extends through the tube body 92. The rotational speed of weight 114 is preferably 5000–6000 RPM. A pivot is established by suitable fasteners 116 within sleeve 90, allowing the weight to pivot like a pendulum. The machined, generally conical impact end 119 (FIG. 7) of the pendulous weight 114 terminates in an integral, reduced diameter, cylindrical portion 122 comprising a relief notch 124 spaced from internal clearance end 132. This construction unbalances the weight 114. Mechanical interference within the interior volume 128 of the hex nosepiece 96 results when the conical portion 119 of the weight forcibly contacts the interior surface 130. As seen in section (i.e., FIG. 7) the side or profile 121 of conical portion 119 is parallel with the surface 130. Importantly, profile 121 and the internal surface profile 130 form a critical angle of approximately 1.0–1.5 degrees with reference to the vibrating head's longitudinal axis 133. I have found through repeated tests that the construction of FIGS. 5–8 is very important to non-destructive, high speed rotation of the vibrator as aforedescribed.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable, hand-held concrete vibrating system to be transported by a user over a construction site for consolidating plastic concrete, said system comprising:

an elongated frame grasped by said user for supporting and transporting the system;

a motor for powering the system, said motor coupled to said frame;

a vibrator head powered by said motor adapted to be immersed in plastic concrete, said vibrator head comprising a pivoted weight that is rotatably, generally coaxially disposed within said head for forcibly causing vibrations in response to internal impacts;

a flexible drive cable extending coaxially within said frame between said motor and said vibrator head; and, compensating means within said vibrator head for accommodating axial and rotational stresses caused by high speed rotation of said weight, wherein said compensating means torsionally couples the flexible drive cable to said weight, said compensating means comprising a rigid power input end coupled to said drive cable, a rigid power output end coupled to said weight, and a flexible midportion connecting said power input end and said power output end, and, wherein said compensating means power input end and said compensating means power output end are disposed adjacent alignment bearings.

2. The vibrating system defined in claim 1 wherein the drive cable is coaxially surrounded by an elongated, resilient, plastic tube that reinforces and lubricates the drive cable.

3. The vibrating system defined in claim 2 wherein the drive cable is rotationally engaged by an axially slidable coupling that is driven by said motor.

4. The vibrating system defined in claim 1 wherein said flexible midportion is made of braded, buna rubber.

5. The vibrating system defined in claim 1 wherein the weight is supported by self-aligning bearings.

6. The vibrating system defined in claim 1 wherein the rotational speed of the weight is between 5000–6000 RPM.

7. The vibrating system defined in claim 1 wherein said weight comprises a generally conical impact end terminating in an integral, unbalanced portion for producing impact in response to rotation.

8. The vibrating system defined in claim 7 wherein the conical impact end has a side profile that is parallel with the profile of a confining, internal volume of the head, and both of said last mentioned profiles form an angle of approximately 1.0–1.5 degrees with reference to the longitudinal axis of said head.

9. A portable, hand-held concrete vibrating system to be transported by a user over a construction site for consolidating plastic concrete, said system comprising:

an elongated frame grasped by said user for supporting and transporting the system;

a two cycle motor for powering the system, said motor coupled to said frame at a first end thereof;

a vibrator head powered by said motor adapted to be immersed in plastic concrete, said vibrator head flexibly coupled to an opposite end of said frame, and said head comprising a pivoted weight that is rotatably, generally coaxially disposed within said head for forcibly causing vibrations in response to internal impacts;

a flexible drive cable extending coaxially within said frame between said motor and said vibrator head for rotating the weight; and, compensating means within said vibrator head for accommodating axial and rotational stresses caused by high speed rotation of said weight, wherein said compensating means torsionally couples the flexible drive cable to said weight, said compensating means comprising a rigid power input end coupled to the drive cable and disposed adjacent self-aligning bearings, a rigid power output end coupled to the weight and disposed adjacent self-aligning bearings, and a flexible midportion connecting said power input end and said power output end.

10. The vibrating system defined in claim 9 wherein the drive cable is coaxially surrounded by an elongated, resilient, plastic tube that reinforces and lubricates said drive cable, and said drive cable is rotationally engaged by an axially slidable coupling that is driven by said motor.

11. The vibrating system defined in claim 10 wherein said flexible midportion is made of braded, buna rubber.

12. The vibrating system defined in claim 11 wherein the rotational speed of the weight is between 5000–6000 RPM.

13. The vibrating system defined in claim 9 wherein said weight comprises a generally conical impact end terminating in an integral, unbalanced portion, the conical end has a side profile that is parallel with the profile of a confining, internal volume of the head, and both of said last mentioned profiles form an angle of approximately 1.0–1.5 degrees with reference to the longitudinal axis of said head.

14. A portable, hand-held concrete vibrating system to be transported by a user over a construction site for consolidating plastic concrete, said system comprising:

an elongated frame grasped by said user for supporting and transporting the system;

a high speed, internal combustion motor for powering, the system, said motor coupled to said frame at a first end thereof and adapted to rotate at speeds of 5000–6000 RPM;

a vibrator head powered by said motor adapted to be immersed in plastic concrete, said vibrator head flexibly coupled to an opposite end of said frame, and said head comprising a pivoted weight that is rotatably, generally coaxially disposed within said head for forcibly causing vibrations in response to rotation and resultant internal impacts;

a flexible drive cable extending coaxially within said frame between said motor and said vibrator head;

compensating means within said vibrator head for accommodating axial and rotational stresses caused by high speed rotation of said weight, wherein said compensating means torsionally couples the flexible drive cable to said weight, said compensating means comprising a rigid power input end disposed adjacent self-aligning bearings and coupled to said drive cable, a rigid power output end disposed adjacent self-aligning bearings and coupled to a portion of said weight, and a flexible, resilient midportion connecting said power input end and said power output end.

15. The vibrating system defined in claim 14 wherein the drive cable is coaxially surrounded for at least a portion of its length by an elongated, resilient, plastic tube that reinforces and lubricates said drive cable, and said drive cable is rotationally engaged by an axially slidable coupling that is driven by said motor.

16. The vibrating system defined in claim 14 wherein said weight comprises a generally conical impact end terminating in an integral, unbalanced portion, the conical end has a side profile that is parallel with the profile of a confining, internal volume of the head, and both of said last mentioned profiles form an angle of approximately 1.0–1.5 degrees with reference to the longitudinal axis of said head.

17. The vibrating system defined in claim 16 wherein the drive cable is coaxially surrounded for at least a portion of its length by an elongated, resilient, plastic tube that reinforces and lubricates said drive cable, and said drive cable is rotationally engaged by an axially slidable coupling that is driven by said motor.

18. The vibrating system defined in claim 14 wherein said flexible midportion is made of braded, buna rubber.

19. The vibrating system defined in claim 14 wherein the rotational speed of the weight is between 5000–6000 RPM.

* * * * *